United States Patent [19]

Mayer et al.

[11] 3,940,515

[45] Feb. 24, 1976

[54] DRY PROCESS FOR THE FINISHING OF ORGANIC MATERIAL

[75] Inventors: Fritz Mayer, Haltingen, Germany; Rudolf Keller, Riehen; Werner Kunz, Uerikon, both of Switzerland

[73] Assignee: Ciba-Geigy Corporation, Ardsley, N.Y.

[22] Filed: Dec. 20, 1972

[21] Appl. No.: 316,805

[30] Foreign Application Priority Data

Apr. 7, 1972 Switzerland ..... 5135/72

[52] U.S. Cl. ..... 427/248; 8/2.5 R; 156/230; 427/148; 427/445

[51] Int. Cl.[2] ... C08J 1/44; D06P 7/00; B44C 31/00

[58] Field of Search ..... 117/138.5, 120, 3.2, 139.5; 8/2.5; 156/230

[56] References Cited

UNITED STATES PATENTS

| | | | |
|---|---|---|---|
| 3,559,317 | 2/1971 | Knight et al. | 117/3.2 |
| 3,707,346 | 12/1972 | Markert et al. | 8/2.5 |

*Primary Examiner*—David Klein
*Assistant Examiner*—Alfonso T. Suro Pico
*Attorney, Agent, or Firm*—Joseph G. Kolodny; Edward McC. Roberts; Prabodh I. Almaula

[57] ABSTRACT

An improved dry process for the finishing of organic material, particularly textile material made from natural or synthetic organic fibres ist described, which comprises applying to an inert carrier preparations containing at least one textile finishing agent transferring at atmospheric pressure above 80°C to the organic material, optionally a bonding agent stable below 250°C, water and/or an organic solvent; drying of the said preparation; bringing into contact then of the treated side of the inert carrier with the surface of the organic material to be finished; subjecting thereupon of carrier and the material to be finished, optionally under mechanical pressure, to a heat treatment at a temperature of at least 80°C until the said textile finishing agent has transferred to the material to be finished, and separating of the finished material from the carrier.

The advantage of the new process is that, since there is no effluent produced, it is possible to use also textile finishing agents which are not biologically decomposable and it offers the possibility of obtaining finishing effects on the inside which differ from those on the outside surface of a fabric, such as is desired in the practice.

7 Claims, No Drawings

DRY PROCESS FOR THE FINISHING OF ORGANIC MATERIAL

The present invention relates to a dry process for the finishing of organic material, particularly textile material made from natural or synthetic organic fibres, as well as to the organic material, as an industrial product, finished by the new process.

The finishing of dyed fibre material is usually carried out as a second operation following dyeing; this is because many desired finishing effects cannot be obtained by simultaneous dyeing and finishing from an aqueous liquor. With the use in many cases of subliming or steam-volatile finishing agents, there easily occurs a contamination of the equipment. Furthermore, it is not possible by means of conventional aqueous finishing processes to obtain different finishing effects, e.g. on the inner and on the outer side of a fabric. The treatment of the effluent can moreover be very costly since many textile finishing agents are biologically difficult or impossible to break down and in some cases are even toxic.

A process has now been discovered which renders possible in a simple manner, and with avoidance of the stated disadvantages, the dry finishing of organic material. The new dry process for the finishing of organic material, particularly textile material made from natural and synthetic organic fibres, consists in the application to an inert carrier of preparations containing iat least one textile finishing agent transferring under atmospheric pressure above 80°C, preferably above 130°C, to the organic material, optionally a bonding agent stable below 250°C, water and/or an organic solvent, and the subsequent drying of the said preparations; the bringing into contact then of the treated side of the inert carrier with the surface of the organic material to be finished; the subjecting thereupon of the carrier and the material to be finished, optionally under mechanical pressure, to a heat treatment at a temperature of at least 80°C, until the said textile finishing agent has transferred to the material to be finished; and the subsequent separation of the finished material from the carrier.

The inert carrier usable according to the process, i.e. a carrier which has no affinity to the employed textile finishing agents, is advantageously a flexible, preferably geometrically stable band, strip or metal sheet having advantageously a smooth surface, the said carrier being stable to heat and consisting of the most diverse materials, e.g. metal such as an aluminium or steel sheet, plastics, or paper or textile sheets optionally coated with a film of vinyl resin, ethylcellulose, polyureathane resin or Teflon. It is advantageous to use flexible sheets of aluminium or, on account of the low cost price, particularly of paper.

The following may be mentioned as textile finishing agents transferring at atmospheric pressure above 80°C to the organic material: textile protective agents, especially biologically active protective substances which impart to the textile material, e.g. bacteriostatic and/or fungistatic and/or fungicidal properties, and finishing agents which produce on the textile material the desired effects, e.g. antistatic, oil- and water-repellent, handle-enhancing or fireproofing effects. The said textile protective agents and/or finishing agents can be applied optionally together with dispersion dyestuffs and/or optical brighteners, which convert under atmospheric pressure at temperatures of, e.g. between 150° and 220°C to the vapour phase, to the material to be finished.

The textile protective agents and finishing agents useable according to the invention are in most cases known, or can be produced by processes known per se. They belong to the most diverse classes.

The compound of the formula

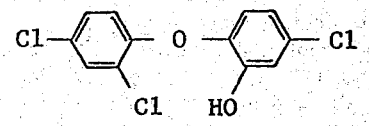

may be given as an example of a bacteriostatic protective substance; and the compound of the formula

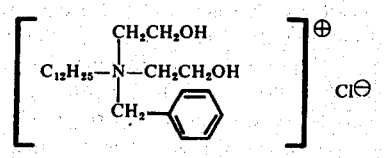

as an example of a fungistatic protective substance.

The compounds of the formulae $HO-(CH_2CH_2C)_{7-15}H$

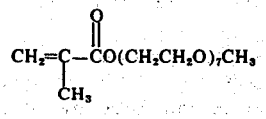

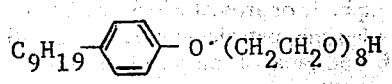

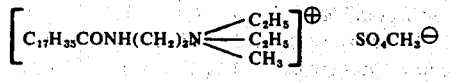

may be mentioned as examples of compounds imparting antistatic properties to the textile material; and paraffin or compounds of the formulae $C_{17}H_{35}NCO$

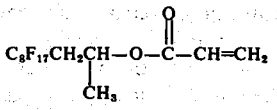

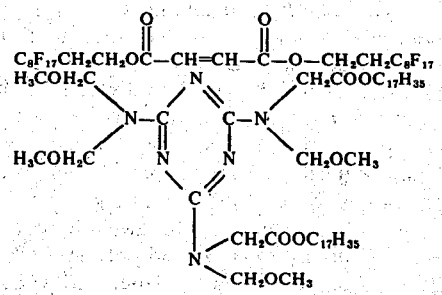

as examples of compounds imparting water-repellent properties to the textile material.

Factors to be taken into account in the selection of the textile finishing agent(s) are, firstly, the desired effects and, secondly, the temperature at which these compounds transfer without decomposition to the organic material. Preferred compounds are ones having transfer temperatures of between 100° and 200°C. To obtain several finishing effects in one operation, it is preferable to use textile finishing agents possessing transfer properties of the greatest possible similarity, i.e. agents having transfer temperatures not differing from each other by more than 20°C.

Bonding agents stable below 250°C, i.e. such agents not melting at the transfer temperature, are obtainable commercially and are used on a large scale for the printing of textile materials. The bonding agents serve solely to retain on the treated area of the carrier the compounds to be transferred, without these being chemically modified by the said bonding agents. The bonding agents preferred are ones which, for example, dry rapidly in a warm air-stream and form on the carrier a fine film, advantageously non-adhesive. The following may be mentioned as suitable water-soluble bonding agents: alginate, tragacanth, carubin (from locust bean flour), dextrin, to a lesser or greater degree etherified or esterified mucilage, carboxymethylcellulose or polyacrylamide; and as suitable bonding agents soluble in organic solvents: cellulose esters such as nitrocellulose or cellulose acetate, and, in particular, cellulose ethers such as methyl-, ethyl-, propyl-, isopropyl-, benzyl- or hydroxyethyl- cellulose, as well as mixtures thereof.

Suitable organic solvents are water-miscible and non-water-miscible organic solvents or solvent mixtures having a boiling point at normal pressure of below 150°C, preferably of below 120°C. Preferred organic solvents are aliphatic or aromatic hydrocarbons such as toluene, cyclohexane, petroleum ether; lower alkanols such as methanol, ethanol, propanol, isopropanol; esters of aliphatic monocarboxylic acids such as acetic acidethyl or -propionic ester; ketones such as methyl ethyl ketone; and halogenated hydrocarbons such as perchloroethylene, trichloroethylene, 1,1,1-trichloroethane or 1,1,2-trichloro-2,2,1-trifluoroethylene. It is advantageous moreover to use mixtures of these solvents, e.g. a mixture of methyl ethyl ketone and ethanol in the ratio of 1:1. The desired viscosity of the printing pastes can then be obtained by addition of the said bonding agents, or by dilution with water or with a suitable solvent.

Organic materials which can be treated according to the invention are natural and, in particular, synthetic fibres. Natural fibres which may be mentioned are: cellulose, wool or silk; and synthetic fibres: cellulose esters such as cellulose-2½- and -triacetate, polyamides such as polyhexamethylenediamineadipate, poly-$\epsilon$-caprolactam or poly-$\omega$-aminoundecanoic acid, polyurethanes, polyesters such as polyethylene glycol terephthalate or polycyclohexanedimethyleneterephthalate, polyacrylonitrile, modified synthetic polyesters or polyamides, polyolefins such as polypropylene, regenerated cellulose such as viscose, or also mixtures of these materials with each other, or, e.g. mixtures of polyacrylonitrile/polyester, polyamide/polyester, polyester/viscose, polyester/cotton and polyester/wool, as well as leather, synthetic leather, paper and wood.

The organic materials can be in the most diverse stages of processing, e.g. in the form of films, sheets, bands, fleece, slubbing, woven and looped fabrics, non-woven or textile floor coverings such as needle-felt carpets, or yarn assemblies.

The preparations useable according to the invention are produced by a process in which the textile finishing agents which transfer at atmospheric pressure above 80°C to the organic material are dissolved or finely dispersed in water and/or solvent or a solvent mixture, advantageously in the presence of a bonding agent stable below 250°C.

These preparations are applied to the carrier by means of, for example, spraying, coating or printing over the whole surface or over part of the surface of the carrier. Printing is carried out by the usual printing processes.

After application of the preparations to the carrier, they are dried, e.g. with the aid of a warm stream of air, or by infrared irradiation, optionally with recovery of the employed solvents.

The treated side of the carrier is thereupon brought into close contact with the surface to be finished of the organic material, and both carrier and material are then subjected to a heat treatment at a temperature of at least 80°C, and preferably 100° to 200°C.

These temperatures are maintained until the textile finishing agents as defined have been transferred to the organic material to be finished, the treatment time being preferably between 5 and 120 seconds.

The action of heat can be applied in various known ways, e.g. by means of a heating plate, or by the passing of the material through a tunnel shaped zone heated, e.g. with hot air, or over a heating drum, advantageously in the presence of a pressure-exerting, unheated or heated plate or backingroll to ensure a uniform contact, or of a hot calender, optionally under vacuum, the said devices being pre-heated by steam, oil, infrared irradiation or microwaves to the required temperature, or located in a preheated heating chamber.

After completion of the heat treatment, the finished material is removed from the carrier.

The finished material requires no aftertreatment: it does not require a steam treatment to fix the textile finishing agent, or a condensation treatment or subsequent washing to improve the fastness properties.

Compared with known processes, the process according to the invention has noticeable advantages. The principal advantage is that, since there is no effluent produced, it is possible to use also textile finishing agents which are not biologically decomposable, so that hence there is no processing of waste-water containing toxic and/or biologically nondecomposable textile finishing agents necessary. Furthermore, the present process offers the possibility of obtaining, optionally simultaneously with the dyeing process, finishing effects on the inside which differ from those on the outside surface of a fabric; e.g., an anti-electrostatic and a bacteriostatic effect on the inside and a water-repellent effect on the outside surface of a fabric, such as is desired in practice, for example, in the case of raincoats or canvas materials.

In the following examples, which do not limit the scope of the invention, 'parts' and 'percentages' relate to weight, and temperatures are expressed in degrees Centigrade.

EXAMPLE 1

An amount of 100 g of the antistatic agent of the formula

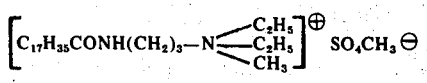

is worked up with 100 g of ethylcellulose Type N (Hercules Co., USA) in 900 g of a mixture of 450 g of methyl ethyl ketone and 450 g of ethyl alcohol by stirring for 1 hour at 35° – 40° to obtain a slightly viscous paste. This paste is applied by spraying, printing or coating (coating knife) to the whole surface of a paper strip so that the amount of antistatic agent present per square metre of strip is 5 g, and subsequently dried. A fabric made from polyethylene glycol terephthalate is placed onto the thus treated carrier and, by means of a heated plate, carrier and material are then brought into contact for 20 seconds at 200°. A second unheated plate ensures a uniform contact. The finished fabric is afterwards removed from the carrier.

A polyethylene glycol terephthalate fabric possessing anti-electrostatic properties is obtained in this manner.

Likewise excellent anti-electrostatic effects on the given materials are obtained by using, instead of a polyethylene glycol terephthalate fabric, a polyamide fabric (hexamethylenepolyadipamide or ε-caprolactam polymerisate), (185°) a wool/polester mixed fabric (185°), a polyacrylonitrile fabric (170°) or a tricel-twill fabric (a triacetate fabric) (200°), the procedure, with exception of the respective contact temperature given in brackets, being otherwise the same as that described in the example.

EXAMPLE 2

An amount of 100 g of the antistatic agent of the formula

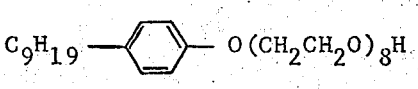

is stirred into 900 g of an aqueous polyvinyl alcohol thickening containing 10 g of polyvinyl alcohol dissolved in 1000 ml of water, and the whole worked up by stirring for 1 hour at 30° – 40° into a slightly viscous paste. By means of coating with a hand-coater, 20 g/m² of the said paste is applied to a non-porous paper, and subsequently dried. Knitted articles made from polyethylene glycol terephthalate, 100 to 200 g/m² in weight, are placed onto the thus treated carrier; carrier and material are then heated for 30 seconds at 185°–195° as close contact betweem them is maintained. The finished knitwear is afterwards removed from the carrier.

There is obtained in this manner knitwear having good anti-electrostatic properties and good hydrophility.

Likewise excellent anti-electrostatic effects on the given materials are obtained by using with otherwise the same procedure as described in the above example, instead of a knitted article made from polyethylene glycol terephthalate, a knitted article made from polyacrylonitrile, or a mixed fabric from polyethylene glycol terephthalate and wool of 100 to 200 g/m² in weight.

Likewise excellent anti-electrostatic effects are obtained on the given materials by using with otherwise the same procedure as described in the example, instead of the aqueous polyvinyl alcohol thickening, one of the following listed thickening agents:

- 300 g of carboxymethylcellulose/1000 ml of water (40:1000),
- 30 g of Solidokoll K (polyacrylamide)/1000 ml of water,
- 300 g of Polyprint M 138 T (mucin derivative)/1000 ml of water (60:1000),
- 300 g of Solvitose C 5 (starch ether)/1000 ml of water (50:1000).

EXAMPLE 3

An amount of 200 g of the textile finishing agent of the formula $$HO-(CH_2CH_2O)_{7-15}H$$

is stirred into 900 g of a 0.6% aqueous alginate thickening, and the whole worked up as described in Example 2 to obtain a slightly viscous paste. By means of coating with a floating knife, 20 g of this paste is applied per square meter to tissue paper, 20 g per square meter in weight and calendered on one side, and subsequently dried. Fabric made from polyethylene glycol terephthalate of 130 g/m² in weight is placed onto the thus treated carrier, and carrier and material held in close contact by means of a heating plate for 25 seconds at 190°. The finished fabric is afterwards removed from the carrier.

Polyethylene glycol terephthalate fabric having an antistatic finish is obtained in this manner.

Similarly excellent antistatic effects on the given material are obtained by using, instead of a polyethylene glycol terephthalate fabric, a fabric made from polyacrylonitrile of 160 g per m² in weight and a contact temperature of 185°, the procedure being otherwise as described in the example.

EXAMPLE 4

An amount of 60 g of the antimicrobic agent of the formula

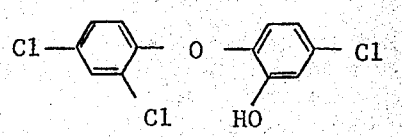

is worked up, as described in Example 1, with 100 g of ethylcellulose and 940 g of methyl ethyl ketone to obtain a paste; the paste is subsequently applied to a paper sheet so that ca. 6 g of the antimicrobic agent per m² is present, and then dried. There is thus obtained, with otherwise the same procedure as in Example 1, a polyethylene glycol terephthalate fabric possessing bacteriostatic properties, particularly against infestation by *Staphylococcus aureus* and *Escherichia coli*

EXAMPLE 5

An amount of 80 g of the bacteriostatic agent of the formula

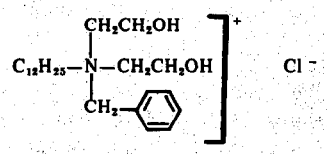

is worked up with 100 g of ethylcellulose, 480 g of ethyl alcohol and 480 g of methyl ethyl ketone, as described in Example 1, to obtain a paste. By means of coating with a hand-coater, 15 g of this paste is applied per $m^2$ to an aluminium foil, and subsequently dried. Polyamide-6.6 fabric of 130 g/$m^2$ in weight is placed onto the thus treated carrier; by means of a heated plate, carrier and material are then kept in contact for 30 seconds at 195°. A second plate ensures uniform contact. The finished material is thereupon removed from the carrier.

A polyamide-6.6 fabric having bactericidal and fungicidal properties is obtained in this manner.

EXAMPLE 6

200 g of the hydrophobic agent of the formula

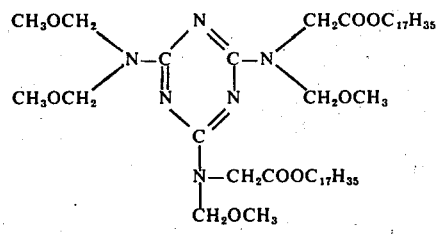

and 100 g of ethylcellulose are worked up in 900 g of tetrachloroethylene to obtain a slightly viscous paste. By means of a coating knife, an amount of 30 g of this paste per $m^2$ is applied to non-porous paper, and subsequently dried. Fabric made from polyethylene glycol terephthalate (130 g/$m^2$) is placed onto the thus treated carrier, and by means of a heating plate carrier and material then kept in contact for 25 seconds at 195°; the fabric is afterwards removed from the carrier.

A polyethylene glycol terephthalate fabric having a water-repellent finish is obtained in this manner.

EXAMPLE 7

200 g of the hydrophobic agent of the formula $C_{17}H_{35}NCO$ and 100 g of ethylcellulose are worked up in 900 g of a mixture consisting of 1 part of ethyl alcohol and 1 part of methyl ethyl ketone, as described in Example 1, to obtain a slightly viscous paste. By means of a hand-coater, the paste is applied to the whole surface of a tissue paper calendered on one side, so that an amount of 6 g of hydrophobic agent per $m^2$ is present, and subsequently dried. Cotton popeline of 130 g/$m^2$ in weight is placed onto the thus treated carrier, and by means of a heating plate, carrier and material maintained in contact for 25 seconds at 195°; the finished material is afterwards removed from the carrier.

A cotton popeline having water-repellent properties and a soft handle is obtained in this manner.

EXAMPLE 8

200 g of the compound of the formula

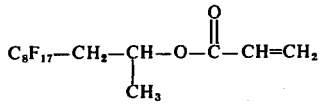

and 100 g of ethylcellulose are worked up in a solvent mixture consisting of 400 g of ethyl alcohol and 400 g of methyl ethyl ketone, as described in Example 1, to obtain a slightly viscous paste. By coating with a coating knife, an amount of 15 g of this paste per $m^2$ is applied to tissue paper of 20 g/$m^2$ in weight, and subsequently dried.

If the treated surface of the carrier is placed onto cotton fabric 140 g/$m^2$ in weight, carrier and material heated by means of a flat iron for 20 seconds at 190°C, and the material subsequently removed from the carrier, then a water- and oil-repellent cotton fabric having a soft handle is obtained.

If, instead of cotton fabric, a mixed fabric made from polyethylene glycol terephthalate and wool, cardboard, paper or wood are used, the procedure being otherwise as described in the example, then these materials too possess good oil- and water-repellent properties.

EXAMPLE 9

150 g of the compound of the formula

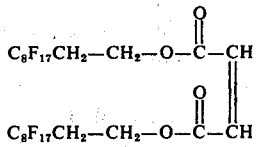

and 100 g of ethylcellulose are worked up in a solvent mixture consisting of 400 g of ethyl alcohol and 400 g of methyl ethyl ketone to obtain a paste. By means of coating, an amount of 15 g of this paste per $m^2$ is applied to aluminium foil, and dried. Cotton fabric of 130 g/$m^2$ in weight is placed onto the thus treated surface of the carrier, and carrier and material maintained in contact by being passed, under a paper runner cloth, through a hot drum for 25 seconds at 190°.

A cotton fabric having water- and oil-repellent properties is obtained in this manner.

Similarly good oil- and water-repellent effects which are also fast to washing are obtained on the below given substrates by using with otherwise the same procedure as described in the example, instead of a cotton fabric, a knitted article made from cellulose-2½-acetate (25 seconds at 170°), cellulose triacetate or polyacrylonitrile, or a mixed fabric made from polyethylene glycol terephthalate and cotton.

EXAMPLE 10

200 g of the hydrophobic agent of the formula

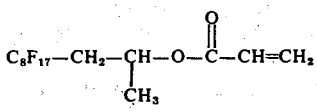

and 100 g of ethylcellulose are stirred into a solvent mixture consisting of 400 g of ethyl alcohol and 400 g of methyl ethyl ketone, and the whole worked up, as described in Example 1, into a slightly viscous paste. By coating with a hand coater, an amount of 15 g of this paste per $m^2$ is applied to non-porous paper, and subsequently dried. Fabric made from polyethylene glycol terephthalate of 180 g/$m^2$ is placed onto the thus treated surface of the carrier, and by means of a heated plate, carrier and material kept in contact for 20 seconds at 190°C. The fabric having on its outside water-repellent properties is afterwards removed from the carrier; the inside of the said fabric is then brought into contact with a carrier for 20 seconds at 185°C, the said carrier having been pretreated as follows:

An amount of 100 g of the antistatic agent of the formula

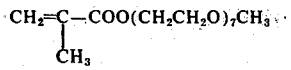

is worked up, as described in Example 1, with 100 g of ethylcellulose, 450 g of ethyl alcohol and 450 g of methyl ethyl ketone to form a paste; this is subsequently applied to the extent of 15 g/m², by means of a hand coater, to non-porous paper, and then dried.

A polyethylene glycol terephthalate fabric is thus obtained which has on its outside hydrophobic and oil-repellent properties, and on its inside anti-electrostatic properties, and which can be used direct, e.g. for the production of raincoats.

EXAMPLE 11

An amount of 150 g of the hydrophobic agent of the formula

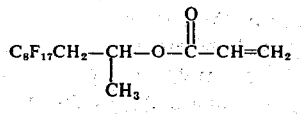

is worked up with 140 g of ethylcellulose, 425 g of ethyl alcohol and 425 g of methyl ethyl ketone, as described in Example 1, to obtain a slightly viscous paste. By coating with a hand coater, 15 g of this paste per m² is applied to non-porous paper, and subsequently dried. Knitted articles made from polyethylene glycol terephthalate (textured) of 150 g/m² in weight are placed onto the surface of the thus treated carrier, and carrier and material held in contact for 20 seconds at 185° by passing a tunnel heated zone heated with hot air. The knitted outer garment treated on its outside to have a water-, dirt- and oil-repellent finish is thereupon into contact on its inside with a carrier coated with a bacteriostatic agent for 20 seconds at 180°C. The bacteriostatic carrier had been previously prepared as follows:

An amount of 50 g of the bacteriostatic agent of the formula

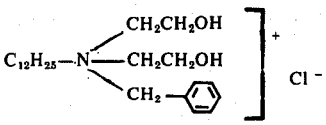

is worked up with 100 g of ethylcellulose, 475 g of ethyl alcohol and 475 g of methyl ethyl ketone, as described in Example 1, to obtain a paste. By means of a hand coater, 15 g of this paste per m² are applied to non-porous paper, and subsequently dried.

A textured polyethylene glycol terephthalate knitted article is obtained in this manner which has on its outside dirt-repellent and rain-drop-repellent properties, and on its inside odour-reducing and bacteriostatic properties.

EXAMPLE 12

100 g of the antistatic agent given in Example 2, 40 g of the antimicrobic agent given in Example 4 and 40 g of the blue dispersion dyestuff of the formula

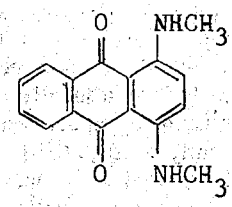

are stirred together with 80 g of ethylcellulose in 860 g of a mixture of 430 g of acetone and 430 g of ethyl alcohol to form a homogeneouus paste. Paper is coated over its entire surface with the printing paste. A tricot made from polyethylene glycol terephthalate is placed onto the thus coated carrier, and carrier and tricot held in contact, by means of a heated calender, for 30 seconds at 190°C. The printed and finished tricot is thereupon removed from the carrier.

A tricot is thus obtained which, simultaneously, has been dyed blue and given anti-electrostatic and bacteriostatic properties.

EXAMPLE 13

200 g of the compound given in Example 8 and 40 g of the red dyestuff of the formula

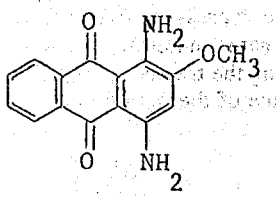

are worked up, as described in Example 1, with 100 g of ethylcellulose in 850 g of a mixture of 425 g of ethyl alcohol and 425 g of methyl ethyl ketone to obtain a paste. This paste is used to print designs on aluminium foil. The parts of the foil not printed with the dyestuff and textile protective agent are printed using a so-called negative-stencil with the textile protective paste given in Example 8.

A blouse material of polyethylene glycol terephthalate is brought into contact, by means of a press of which the one plate is heated, for 30 seconds at 185°C with the treated surface of the aluminium carrier. The printed and finished fabric is thereupon separated from the carrier.

Blouse material made from polyethylene glycol terephthalate is thus obtained which, simultaneously, has been printed red in parts and given overall oil- and water-repellent properties.

If, instead of the blouse material made from polyethylene glycol terephthalate, outer-garment materials made from cellulose-2½-acetate or -triacetate are used, the procedure, with exception of a contact temperature of 170° for cellulose-2½-acetate, being otherwise a described in the example, then there are obtained on these fabrics too red printings in parts and an oil- and water-repellent finish over the whole surface.

EXAMPLE 14

Fine-screen printing designs having up to six colours or colour combinations, which are printed on paper with pastes, the pastes being obtained by the stirring-in of 100 g of each of the corresponding dispersion dyestuffs which convert at atmospheric pressure between 160° and 220° to the vapour phase, and 100 g of ethylcellulose into 900 g of a mixture of 450 g of ethyl alcohol and 450 g of methyl ethyl ketone, and stirring at 35°–40′ for 1 hour to form a slightly viscous paste, are coated with an antistatic agent according to Example 2 or 3, and subsequently dried. A fabric made from polyethylene glycol terephthalate is placed onto the thus treated carrier, whereupon carrier and fabric are brought into close contact by means of a heated plate for 25 seconds at 190°. A second unheated plate ensures a uniform contact. The carrier and the fabric are afterwards separated.

There are thus obtained, in one operation, sharp printing contures and, simultaneously, anti-electrostatic effects on polyethylene glycol terephthalate fabric.

We claim:

1. A dry process for the finishing of organic material, comprising the steps of a. applying to an inert carrier a preparation containing a film-forming bonding agent which is stable below 250°C and at least one textile finishing agent selected from the group consisting of bacteriostats, fungistats, fungicides, antistatic agents, oil repellants, water repellants, handle-enhancing agents, and fire proofing agents which is transferable at atmospheric pressure above 80°C and below 250°C to the organic material, b. contacting the treated side of the inert carrier with the surface of the organic material to be finished, c. heating the inert carrier and the organic material in contact therewith to a temperature of above 80°C and below 250°C until a useful amount of the textile finishing agent has transferred to the organic material, and d. separating the finished organic material from the inert carrier.

2. The process of claim 1, wherein the inert carrier is paper or aluminum foil.

3. The process of claim 1, wherein the textile finishing agent has a transfer temperature in the range of 100° to 200°C and the inert carrier and the organic material to be finished are heated in contact at a temperature above 100°C.

4. The process of claim 1, wherein the organic material is a textile material of cellulose, wool, cellulose ester, synthetic polyamide, polyester, polyacrylonitrile, or mixtures thereof.

5. The process of claim 1, wherein the inert carrier and organic material are contacted and heated at a temperature in the range of 100° to 200° for 5 to 120 seconds.

6. The process of claim 1, wherein the preparation applied to the inert carrier further contains water or an organic solvent or mixtures thereof.

7. The process of claim 1, wherein the inert carrier and the organic material are subjected to mechanical pressure at the point of contact, during the heating step.

* * * * *